United States Patent [19]

Virtue

[11] Patent Number: 4,768,833

[45] Date of Patent: Sep. 6, 1988

[54] CHAIR CONSTRUCTION

[75] Inventor: Julian A. Virtue, Los Angeles, Calif.

[73] Assignee: Virco Mfg. Corporation, Torrance, Calif.

[21] Appl. No.: 884,055

[22] Filed: Jul. 10, 1986

[51] Int. Cl.[4] ..... A47C 7/16; A47C 7/40

[52] U.S. Cl. ..... 297/444; 297/452; 297/DIG. 2

[58] Field of Search ..... 297/443, 444, 452, 458, 297/459, DIG. 2

[56] References Cited

U.S. PATENT DOCUMENTS

| | | | |
|---|---|---|---|
| 523,287 | 7/1894 | Kollenberg | 297/444 X |
| 2,625,988 | 1/1953 | MacMillan | 297/444 X |
| 2,845,998 | 8/1958 | Estabrook et al. | 297/459 |
| 3,159,428 | 12/1964 | Schier | 297/452 |
| 3,171,691 | 3/1965 | Buehrig | 297/452 |
| 4,522,447 | 6/1985 | Snyder et al. | 297/DIG. 1 |

FOREIGN PATENT DOCUMENTS

| | | | |
|---|---|---|---|
| 2148907 | 4/1972 | Fed. Rep. of Germany | 297/DIG. 2 |
| 716612 | 10/1966 | Italy | 297/444 |

*Primary Examiner*—Peter A. Aschenbrenner
*Assistant Examiner*—Peter R. Brown
*Attorney, Agent, or Firm*—James E. Brunton

[57] ABSTRACT

A utility chair having spaced apart leg members, a frame supported by the leg members having a base portion and a back portion, the improvement consisting of a one-piece blow molded hollow back member and a one-piece blow molded hollow seat member adapted to be mounted on the base portion. The seat member comprises integrally formed front, back, top, and bottom walls. The top wall is vertically spaced from the bottom wall and is yieldably deformable. An upstanding reinforcing member is integrally formed with the bottom wall for providing rigidity to the seat member while at the same time permitting the top wall to flex downwardly a limited distance upon downward forces being exerted on the upper surfaces of the seat, thereby providing a cushioning effect.

2 Claims, 3 Drawing Sheets

CHAIR CONSTRUCTION

BACKGROUND OF THE INVENTION

1. Field of the Invention

The present invention relates generally to utility chairs and their method of construction. More particularly, the invention concerns utility chairs which embody unique, blow molded seat and back portions which simulate the appearance of the padded seat and back cushions typically found in utility chairs but which provide much greater strength, durability and longevity without the sacrifice of comfort.

2. Discussion of the Prior Art

In recent times, utility chairs of various designs have become quite popular for both home and institutional use. Such chairs, which may include stacking chairs, kitchen chairs, dining chairs, high chairs and the like, frequently embody padded, box style seat and back cushions which are attached to the chair frame by various types of conventional fastening means. Typically, the cushions are constructed of rubber, foam or plastic base materials which are formed to the desired shape and then covered with fabric, vinyl, plastic or other upholstery materials. While these types of utility chairs are very functional and are designed for use in a wide variety of different situations, design esthetics and comfort have played a major part in both their creation and overall popularity.

The provision of seat and back cushions for utility chairs which are both comfortable and attractive and yet are suitably durable to withstand the rough use which is made of such chairs has presented challenging design problems. Although cushions covered with vinyl or other plastic materials are attractive and easily washable, they are also susceptible of being cut, abraded and otherwise damaged during use. Fabric covered cushions are less easily washed and are also easily cut and torn during use.

The novel chair construction of the present invention overcomes the drawbacks of prior art utility chairs by providing a novel, blow molded seat and back cushion constructed of a blow moldable plastic, which has the appearance and comfort of a conventional box style upholstered cushion, but which is virtually indestructable.

SUMMARY OF THE INVENTION

It is an object of the present invention to provide a blow molded article suitable for use in utility chair construction as a substitute for padded seat cushions of the character hitherto used in such chair construction.

It is another object of the present invention to provide an article of the aforementioned character which is strong and durable in use, but at the same time exhibits sufficient resiliency to make it comfortable when used as a seat cushion.

Another object of the present invention is to provide an article of the class described in which the surfaces of the article are easily washable, are impervious to food and beverage stains and require no special finishing or upholstery. An additional object of the invention is to provide such an article with improved qualities of resistance to wear and deterioration and which will not bend, warp or crack in the presence of heat and moisture.

Still another object of the invention is to provide an article of the character described in the preceding paragraphs which is integrally formed in a one-step blow molding operation to provide a single piece structure which closely simulates the appearance of a padded, upholstered seat cushion. To provide rigidity to the structure while at the same time permitting the seating surface to flex downwardly for comfort, novel reinforcing means are integrally molded interiorly of the hollow seat structure and extend upwardly from the bottom wall to a location proximate, but spaced apart from, the top wall.

Yet another object of the invention is to provide an article suitable for use as a seat cushion in utility chairs which has sufficient overall strength to retain screws and to adequately resist all stresses and strains normally encountered in components of utility furniture. in this regard, frustoconically shaped screw receiving indentations are integrally formed with the bottom wall of the structure during the blow molding operation.

Another important object of the present invention is to provide a one piece, blow molded seat back, having the durability and wear attributes previously described, for use in utility chairs in which the seat back is provided with integrally formed side ribs adapted to be lockably inserted into mating slots formed in the side frame members of the chair. With this novel construction no screws need be used to rigidity interconnect the seat back with the chair frame.

These and other objects are achieved by a chair construction of the character having spaced apart leg members, a frame supported by the leg members having a base portion and a back portion, the improvement comprising a one-piece hollow back member and a one-piece hollow seat member adapted to be mounted on the base portion. The seat member comprises integrally formed front, back, top, and bottom walls. The top wall is vertically spaced apart from the bottom wall and is yieldably deformable. A reinforcing member is integrally formed with the bottom wall for providing rigidity to the seat member while at the same time permitting the top wall to flex downwardly a limited distance upon downward forces being exerted on the upper surfaces of the seat member.

DESCRIPTION OF THE INVENTION

Figure 1:
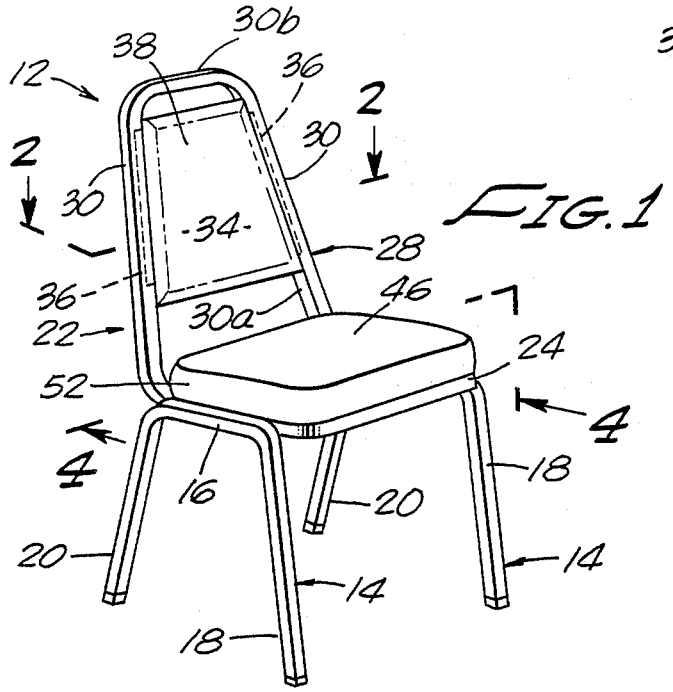
FIG. 1 is a generally perspective view of the chair of the present invention.
Figure 3:
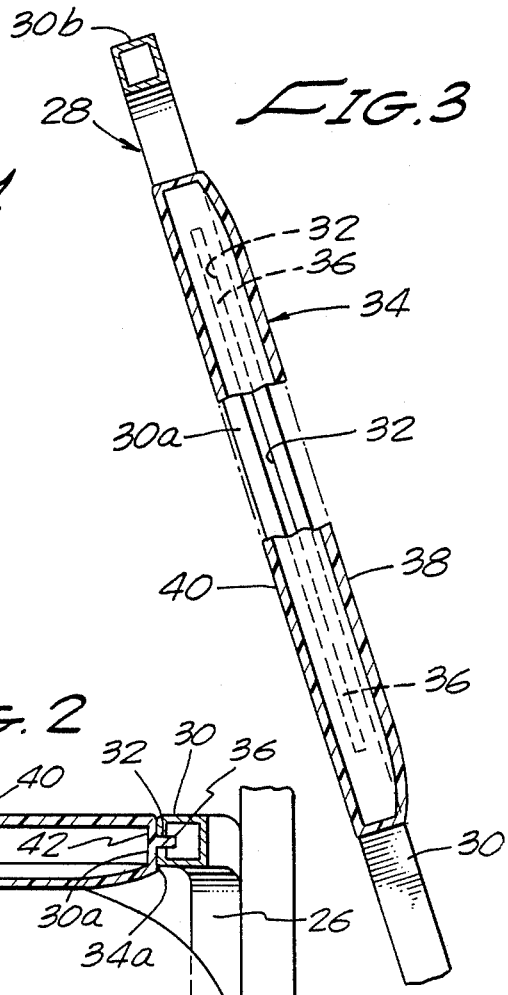
FIG. 3 is a longitudinal cross-sectional view taken along lines 3—3 of FIG. 2 further illustrating the construction of the back rest portion of the chair frame.
Figure 2:
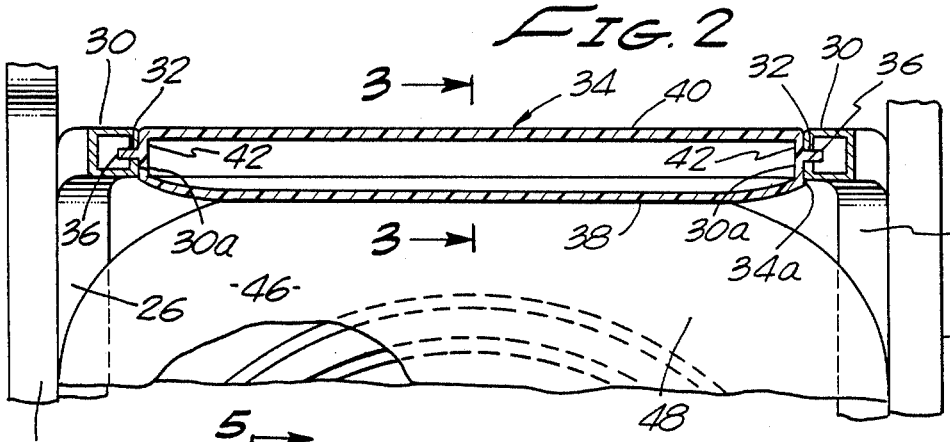
FIG. 2 is a cross-sectional view taken along lines 2—2 of FIG. 1 showing the construction of the back rest and the way in which the back rest is held in position within the slotted frame members of the chair.

Referring to the drawings, and particularly to FIG. 1, the chair structure of the present invention, generally designated by the numeral 12, comprises a pair of laterally spaced, generally U-shaped leg members 14, each having an upper bight portion 16, a front leg portion 18 and a rear leg portion 20 depending from upper portion 16. A frame 22 is supported by the leg members and comprises a base portion 24 having transversely spaced apart side members 26 (FIGS. 2 and 4) and a back portion 28. As best seen by referring also to FIGS. 2, 3 and 4, back portion 28 includes transversely spaced apart side members 30 having inwardly facing surfaces 30*a* provided with elongated slots 32 (FIG. 2). The chair structure is preferably formed of metal tubing such as steel or aluminum.

Forming an important feature of the present invention is a one-piece hollow back rest member 34 which has transversely spaced sides 34*a* each having an elongated outwardly protruding rib 36 adapted to be lockably received within slots 32 formed in the inwardly facing surfaces 30*a* of side members 30 of the back frame portion. As best seen in FIG. 2, back rest member also includes spaced apart, substantially rigid front and back walls 38 and 40 respectively integrally formed with transversely spaced apart side walls 42. As will be discussed in greater detail hereinafter, backrest portion 34 is uniquely blow-molded in a single piece such that the air space between the front and back walls 38 and 40 provide a controllable degree of cushioning to the user of the chair.

Figure 4:
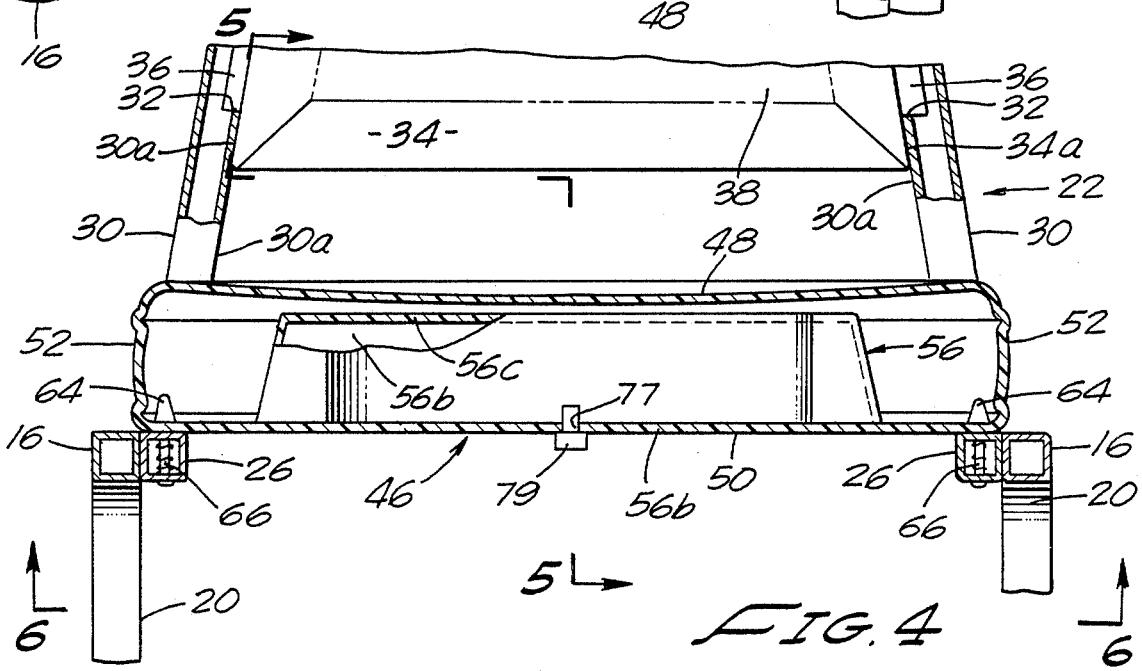
FIG. 4 is a cross-sectional view taken along lines 4–4 of FIG. 1 illustrating the internal construction of the seat portion of the chair and showing the configuration of the reinforcing standoff members.

As indicated in FIGS. 1 and 4, the side members 30 of the back portion of the frame converge toward a bight portion 30*b* which is of a length less than the spacing between the side members 30 at the location wherein they join the spaced apart base members 26 of the frame. Because of the unique manner in which the back rest member is blow-molded, the side portions can be yieldably deformed, or flexed, out of the plane of the back rest member in a manner to permit the outwardly protruding ribs 36 formed thereon to be simultaneously inserted within the slots 32 formed in second side members 30. Once the ribs 36 are received into the slots 32 and the side portions released, the back rest member returns to its normal pland and is firmly and fixedly supported within the back portion of the chair frame without the necessity of using any type of screws, bolts or other fasteners.

Figure 5:
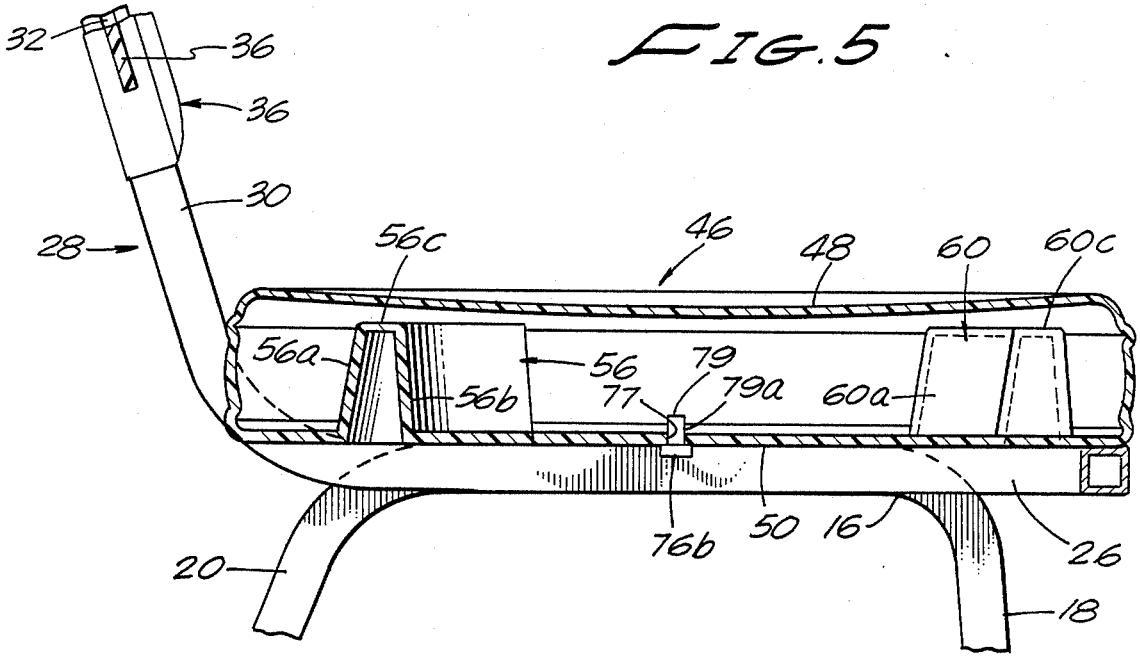
FIG. 5 is a cross-sectional view taken along lines 5—5 of FIG. 4 further illustrating the construction of the molded seat portion of the chair and the design of the reinforcing standoff members.
Figure 6:
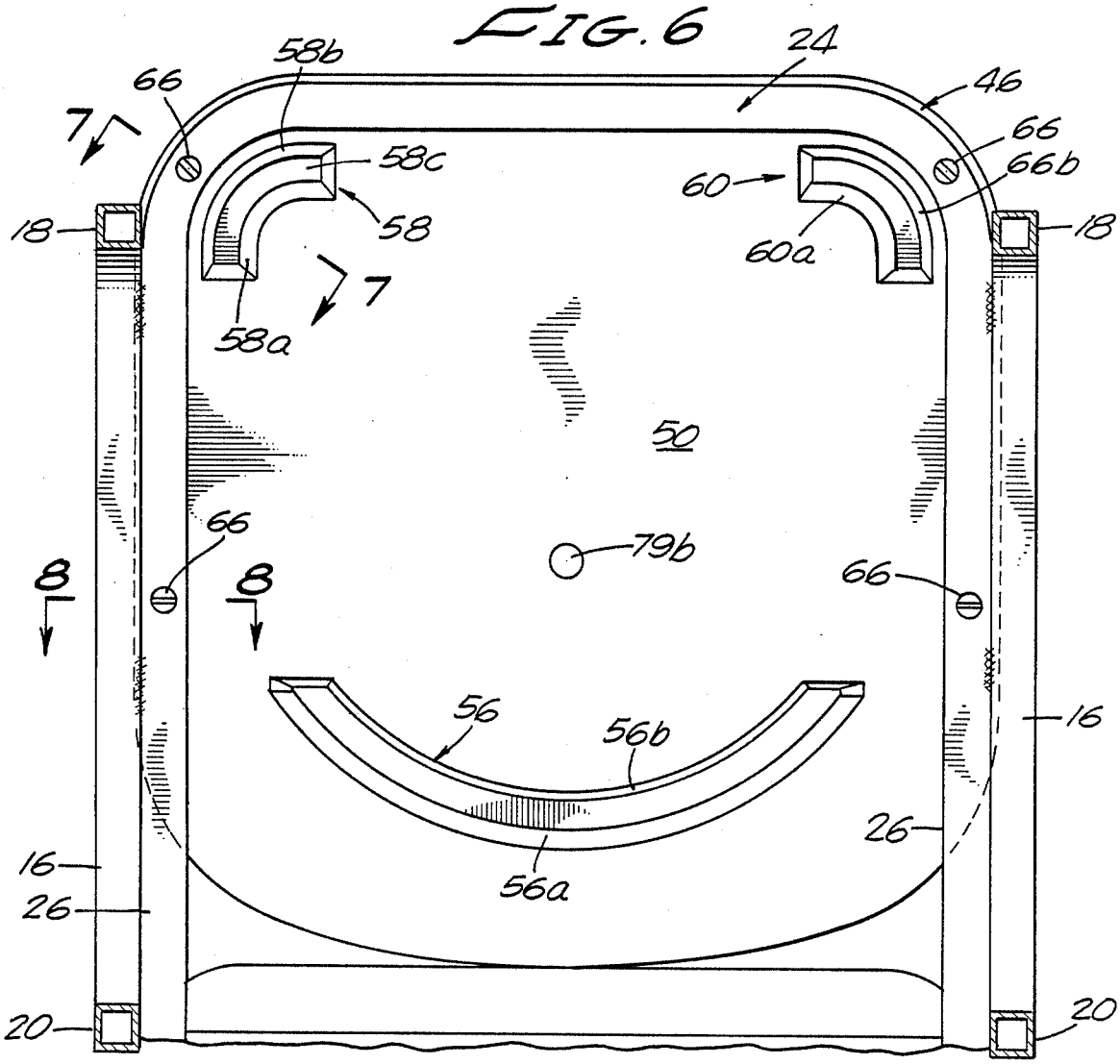
FIG. 6 is a bottom view of the chair illustrating the configuration of the standoff members and showing the method by which the chair seat is attached to the frame of the chair using threaded fasteners.

Also forming an important aspect of the present invention is the one-piece, blow molded hollow seat member 46 which is adapted to be carried on the base portion of the frame 28. As best seen by referring to FIGS. 4, 5 and 6, hollow seat member 46 comprises interconnected substantially rigid top, bottom and side walls 48, 50 and 52 respectively. Uniquely constructed upstanding reinforcing means are disposed intermediate bottom wall 50 and top wall 48 for providing rigidity to the seat member while at the same time permitting limited downward flexing of the top wall 48. In the embodiment of the invention shown in the drawings the reinforcing means comprise first, second and third arcuately shaped upstanding reinforcing members 56, 58 and 60 respectively (FIG. 6). Turning to FIGS. 4 and 5, first reinforcing member 56 is integrally formed with the bottom wall 50 of the seat member and includes a pair of spaced apart, upstanding walls 56*a* and 56*b* which converge slightly and terminate in a generally arcuately shaped top wall 56*c*. As shown in FIG. 4, top wall 56*c* is spaced a predetermined, limited distance from upper wall 48 of the seat member 46.

As indicated in FIG. 6, the smaller second and third arcuately spaced reinforcing members 58 and 60 are transversely spaced apart. Member 58 includes upstanding walls 58*a* and 58*b* which converge slightly and terminate in an upper wall 58*c*. As shown in FIG. 5, upper wall 58*c* is spaced a predetermined limited distance from the upper wall 48 of seat member 46. Similarly, member 60 includes upstanding walls 60*a* and 60*b* which terminate in an upper wall 60*c*. Upper wall 60*c* is also spaced a predetermined limited distance from the upper wall 48 of seat member 46.

With the unique construction of the seat member thus described, the seat member provides, in effect, an air cushion so that when the user is seated on upper wall 48, a certain amount of give, creating a cushioning effect, is possible. Stated another way, the weight of the user on upper wall 48 of the seat member will cause it to deform downwardly a limited distance against the cushion of air trapped within the hollow seat member until a point is reached wherein the top wall 48 moves into engagement, or into near engagement, with the arcuately upstanding reinforcing members.

Figure 7:
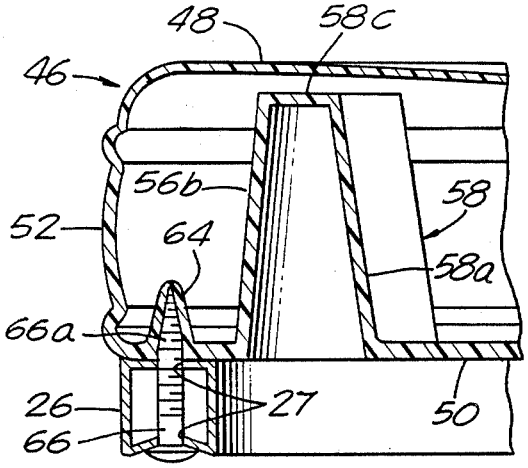
FIG. 7 is a cross-sectional view taken along lines 7—7 of FIG. 6 illustrating particularly the construction of the indentations which are integrally formed in the seat and which are adapted to receive the threaded fasteners.
Figure 8:
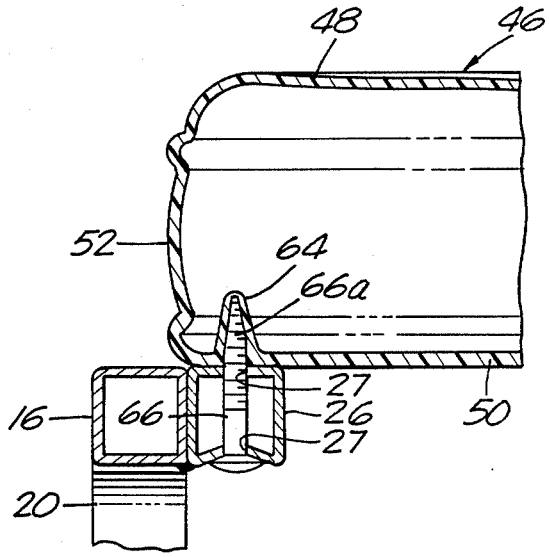
FIG. 8 is a cross-sectional view taken along lines 8—8 of FIG. 6 further illustrating the manner in which the chair seat is affixed to the chair frame by the threaded fasteners.

Another important aspect of the seat cushion construction of the present invention is the provision of a plurality of upstanding frustoconically shaped members 64 which are integrally formed with bottom wall 50 of the seat members and are disposed proximate the side walls thereof for closely receiving threaded fasteners 66. Referring also to FIGS. 7 and 8, fasteners 66 are here provided in the form of elongated externally threaded screws which are receivable within drilled apertures 27 formed in frame members 26 of the chair. Fasteners 66 have tapered end portions 66*a* which are threadably receivable within the interior surfaces of the frustoconically shaped fastener receiving members or protuberances 64.

In fastening the seat 46 to the supporting frame, the seat is placed in position on frame members 26 so that the drilled holes 27 align with protuberances 64. The threaded screws 66 are then inserted through the drilled holes 27 in frame members 26 and are threaded into the frustoconically shaped protuberances 64 so that the tapered portion 66*a* of the screw threads itself into the internal surfaces of the plastic walls of the protuberances 64. In this way, the seat member is firmly and securely interconnected with the chair frame by means of the fasteners 66. While four fasteners 66 and four protuberances 64 are illustrated in FIGS. 6 through 8 of the drawings, it is to be understood that additional fasteners and fastener receiving protuberances 64 can be provided to insure that the seat member will be rigidly and securely affixed to the frame.

Figure 9:
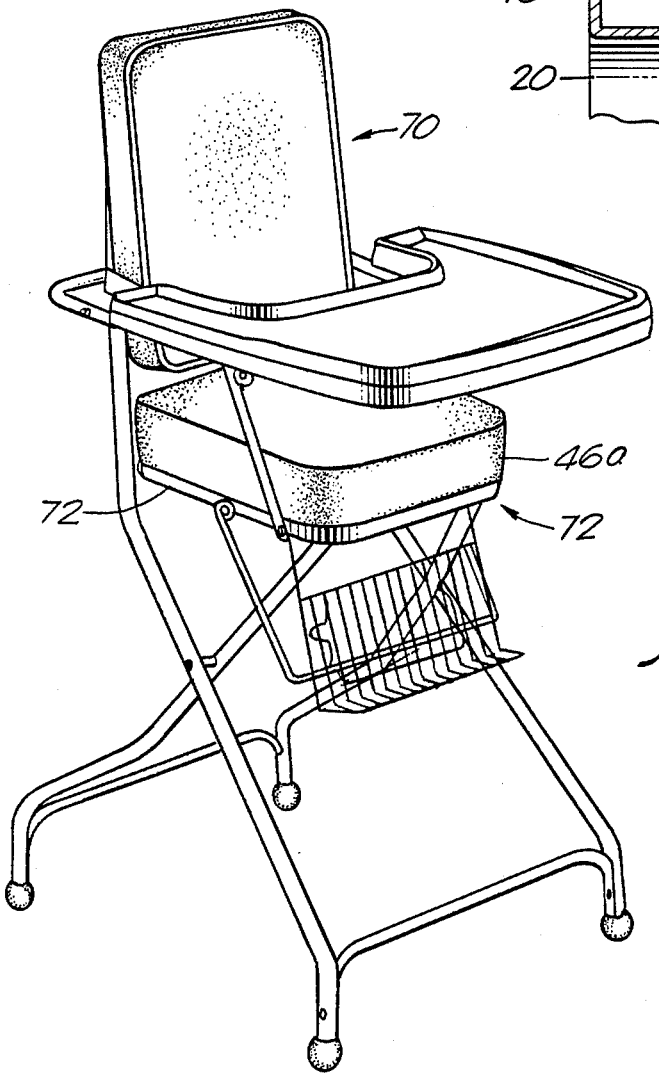
FIG. 9 is a generally perspective view of a highchair embodying molded seat and back portions constructed in accordance with the method of the present invention.

Referring now to FIG. 9, there is shown another form of chair in which the unique seat construction of the invention as described in the preceding paragraphs can be used. In this instance a high chair, generally designated by the numeral 70, embodies the novel seat construction of the present invention. High chair 70 is provided with a tubular metal seat frame assemblage 72 which is of a configuration similar to the seat frame of the chair 12 and is provided with side portions, or frame members, 72 comparable to frame members 26 of the chair construction previously described. In the form of the invention shown in FIG. 9, a seat member designated in FIG. 9 by the numeral 46*a* can be used as the seat cushion for the high chair. The internal construction and method of affixing the seat member 46*a* to the frame members 72 of the high chair of FIG. 9 is identical to that previously described and will not be repeated herein.

It is, of course, to be understood that the seat and back member construction as described in the preceding paragraphs can be used equally well in a wide variety of different types of utility chairs including kitchen chairs, stacking chairs, patio chairs and the like.

In making the hollow seat and back of the present invention, suitable split molds are first produced. The mold for the seat member 46 comprises mating cavities each having interior top, side and end walls of a configuration conforming to the exterior configuration of the seat member 46. One half of the mold is provided with upstanding arcuate segments corresponding in configuration to the arcuate segments 56, 58 and 60 of the seat member 46. This mold is also provided with frustoconically shaped protuberances corresponding in configuration to the fastener receiving protuberances 64 of the character previously described herein.

The mold for the back is constructed of two halves, one having a cavity having surfaces corresponding to the front surfaces of the generally pillow shaped back member 34 and the other having a cavity having surfaces corresponding to the shape of the rearward surfaces of the back portion. This mold is also provided proximate its parting line with a cavity designed to form the elongated locking members, or tabs, 36 provided on the sides of the back member 34. These tabs 36 are rigidly formed of a thickness so that they are closely receivable within the elongated slots 32 formed in back frame members 30.

In blow-molding the seat and back components of the chair, a molten parason is formed of a blow-moldable plastic as, for example, polyethylene. The mold halves are then closed about the parason and air, or other gas, is introduced interiorly of the parason through an air inlet formed in the mold. The introduction of air into the molten plastic parason causes the plastic to be forced outwardly into intimate engagement with the inner surfaces of the mold, thereby precisely forming the exterior surfaces of the molded member in the desired shape. As can be seen by referring to FIGS. 5 and 6, the opening formed in the seat member 46 for the introduction of air into the interior of the mold is designated in these Figures by the numeral 77. This opening, or aperture, 77 is conveniently closed by a plug member 79 having a shank portion 79*a* closely receivable within aperture 77 and a head portion 79*b* which engages the lower surface 52 of the chair member.

If desired, the interior surfaces of the mold defining the seat cushion top and side walls can be shaped and suitably embossed so that the seat cushion surfaces formed thereby simulate the appearance of a traditionally configured seat cushion of the character found in prior art utility chairs.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A chair structure comprising:

(a) a pair of laterally spaced leg members each having an upper portion and a front and rear leg portion depending therefrom;

(b) a frame supported by said leg members, said frame having:

(i) a base portion including transversely spaced apart first side members; and (ii) a back portion including transversely spaced apart second side members having inwardly facing surfaces each of said surfaces being provided with an elongated slot;

(c) a generally planar, substantially rigid backrest member including spaced apart, substantially rigid front and back walls and transversely spaced apart sides integrally formed with said back and side walls, each side side having an elongated, outwardly protruding rib adapted to be lockably received within said slots formed in said inwardly facing surfaces of said second side members of said back portion upon yieldable deformation of said backrest member out of plane, whereby said sides can be yieldably flexed to permit said outwardly protruding ribs to be lockably inserted within the slots of said second side members; and (d) a hollow seat member mounted on said base portion of said frame, said seat member including:

(i) interconnected, substantially rigid top, bottom and side walls; and (ii) reinforcing means disposed intermediate said bottom wall and said top wall for providing rigidity to said seat member while permitting limited downward flexing of said top wall.

2. A chair construction as defined in claim 1 in which said elongated, outwardly protruding ribs are integrally formed with said transversely spaced apart sides.

* * * * *